US005322498A

United States Patent [19]

Lehmann et al.

[11] Patent Number: 5,322,498

[45] Date of Patent: Jun. 21, 1994

[54] BUCKLE FOLDING MACHINE HAVING A MOVEABLE DEFLECTOR

[75] Inventors: Werner Lehmann, Gutach; Wilfried Dorer, DS-Grüningen, both of Fed. Rep. of Germany

[73] Assignee: Firma Mathias Bäuerle GmbH, Georgen/Schw., Fed. Rep. of Germany

[21] Appl. No.: 998,520

[22] Filed: Dec. 30, 1992

[30] Foreign Application Priority Data

Aug. 17, 1992 [DE] Fed. Rep. of Germany ... 9211016[U]

[51] Int. Cl.[5] ..... B31F 1/00

[52] U.S. Cl. ..... 493/420; 493/421

[58] Field of Search ..... 271/184, 225, 302, 303, 271/902; 493/420, 421

[56] References Cited

U.S. PATENT DOCUMENTS

| | | | |
|---|---|---|---|
| 1,832,988 | 11/1931 | Kleinschmit et al. | 493/420 |
| 4,202,621 | 5/1980 | Yoshimura et al. | 271/902 X |
| 4,402,679 | 9/1983 | Heina | 493/420 |
| 4,657,238 | 4/1987 | Nishikawa | 271/902 X |
| 5,037,364 | 8/1991 | Whittenberger | 493/421 X |

FOREIGN PATENT DOCUMENTS

| | | | |
|---|---|---|---|
| 2427850 | 12/1975 | Fed. Rep. of Germany . | |
| 3835124 | 4/1990 | Fed. Rep. of Germany . | |
| 3930855A1 | 3/1991 | Fed. Rep. of Germany | B65H 45/16 |
| 4036530 | 5/1992 | Fed. Rep. of Germany . | |

*Primary Examiner*—D. Glenn Dayoan
*Assistant Examiner*—Boris Milef
*Attorney, Agent, or Firm*—McGlew and Tuttle

[57] ABSTRACT

A buckle folding machine with at last one pair of folding rollers and at least one folding pocket (1). The folding pocket includes a top rail (43), which extends over the width of the folding pocket (1) and is attached to lateral toothed belts (26, 27) and has, on its side facing the folding pocket mouth (9), a plurality of stop fingers (44). The stop fingers have front end faces (48), located in a common plane, serve together as a paper stop within the folding pocket (1), and which can be brought by the toothed belts (26, 27) into a front deflecting position, in which their front end faces (48) together act as a paper deflector and guide the material arriving at the folding pocket mouth (9) for folding past the folding pocket (1) and into the next folding station (F2).

11 Claims, 3 Drawing Sheets

IV
III
II
1
2
3
10
12
14
15
15'
16
21
21'
23
24
25
26
27
28
29
30
31
32
33
34
35
36
37
38
39
42
43
44
60
61

BUCKLE FOLDING MACHINE HAVING A MOVEABLE DEFLECTOR

FIELD OF THE INVENTION

The present invention pertains to a buckle folding machine with at least one pair of folding rollers and with at least one folding pocket, which has a stop rail which extends over the width of the folding pocket and is attached to lateral adjusting elements, as well as with a paper deflecting means, which can be brought by the stop rail from a position in which it keeps open the mouth of the folding pocket into a deflecting position locking the mouth of the folding pocket, wherein the stop rail can be adjusted individually by means of an electric drive acting on the adjusting elements by means of a programmable control device or manually to determine the folding length and the folding pattern.

BACKGROUND OF THE INVENTION

In buckle folding machines, the paper deflectors, which can be actuated by electromagnetic drive means and restoring springs and are each arranged in front of a folding pocket and can be moved into a corresponding locking position to close the mouth of the folding pocket, consist—because of the usually limited space available between the mouth of the folding pocket, on the one hand, and the folding rollers located in front of it, on the other hand—of relatively thin, rod-shaped profiled parts, which may have, like the folding pockets, a length of 50 cm or more. Therefore, at right angles to their flat side, they have a relatively low flexural strength, which may lead to an insufficient guiding function during the processing of thick or heavy paper or during the processing of a plurality of paper sheets together, if the paper deflector is located in its locking position, in which it closes the mouth of the folding pocket. This insufficient bending strength may lead to excessive sagging of the paper deflector and to jamming of paper.

This disadvantage is also present in a prior-art paper-guiding device of the type mentioned in the introduction (DE 39,30,855 A1), in which the paper deflector has a convex guiding surface on one of its flat sides, and this guiding surface directs, in its resting position, the material arriving for folding into the folding pocket, and the opposite flat side of this paper deflector has a concave guiding surface, which guides the material to be folded past the folding pocket in its locking position. Due to the compact design of this prior-art device, and because the paper deflector performs a three-dimensional turning movement rather than a limited pivoting movement around a stationary axis during changeover from one functional position into the other, only little space is available in terms of cross section for accommodating the paper deflector in such a way as to ensure correct functioning. Therefore, the cross-sectional profile of the paper deflector cannot be designed for a bending strength that would be sufficient for all cases.

To impart higher stability to the paper deflector in its locking position in which it closes the mouth of the folding pocket in a paper-guiding device of the type described above, it has also been suggested that a support rail, which is in functional connection with the switching elements of the paper stop, is in contact with the rear side of the paper deflector when the latter is in the locking position, and is in a starting position located at a spaced location from the paper deflector in the resting position of the paper deflector, be arranged on the side of the paper deflector facing the folding pocket.

Aside from the fact that the guide rail, which is insufficient in itself, is still present in this solution as well, and it does not guarantee sufficient reliability of operation under an extreme load, the combination of the mechanical control and actuating means for the paper deflector with the additional support rail and its actuating means represents a complicated and expensive design, which may involve several sources of malfunction.

SUMMARY AND OBJECTS OF THE INVENTION

The primary task of the present invention is to provide, in a buckle folding machine of the type mentioned at the beginning, a paper deflector means, which can be brought into its locking position, in which it closes the mouth of the folding pocket, and can be removed from this position in a simpler manner and with a less complicated design, and which has the stability required for trouble-free operation even under maximum load.

This object is attained according to the present invention by the stop rail having, on its side facing the mouth of the folding pocket, a plurality of stop fingers, whose front end faces, located in a common plane, act together. as a paper stop within the folding pocket and which can be brought by the adjusting elements into a front deflecting position, in which their front end faces together act as paper deflectors and direct the material arriving at the mouth of the folding pocket for folding past the folding pocket and into the next folding station.

The solution according to the present invention integrates the paper deflector means and the paper stop rail of the folding pocket into one structural unit, thus simplifying it substantially in terms of both the design effort and its functional adjustment. However, what is most important is that a stop stability that is sufficient even for highest loads is achieved in the deflecting position of the stop fingers, because the stop rail itself, reinforced by the stop fingers, is able to absorb even strong stop forces.

Further features of the invention include the adjustment of the front deflecting position of the stop fingers corresponding to different thicknesses of the material to be folded. Further, the end faces of the stop fingers are advantageously provided with a height that is only slightly smaller than a distance between two folding rollers arranged in the area of the folding pocket mouth. The front end faces of the stop fingers are preferably formed with a concave arc. Preferably, the stop fingers are pivotable by at least 3° in a vertical direction with respect to the stop rail or relative to the stop rail. In their deflecting position, the stop fingers lie on a stationary guide bar which forms a lower lip of the folding pocket mouth. A guide rail is preferably arranged at a vertical distance approximately corresponding to the height of the stop fingers, above the guide bar. The guide rail extends in parallel to the guide bar and lies on the stop fingers in the deflecting position in order to stabilize the position of the stop fingers. The stop fingers preferably have on their undersides a longitudinal groove with a groove surface area lying on a lattice. bar or on a guide rib of the folding pocket bottom. These features are especially advantageous in guaranteeing a simple and inexpensive design and in addition, reliable operation.

It is a further object of the invention to provide a buckle folding machine which is simple and straight forward in design, rugged in operation and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
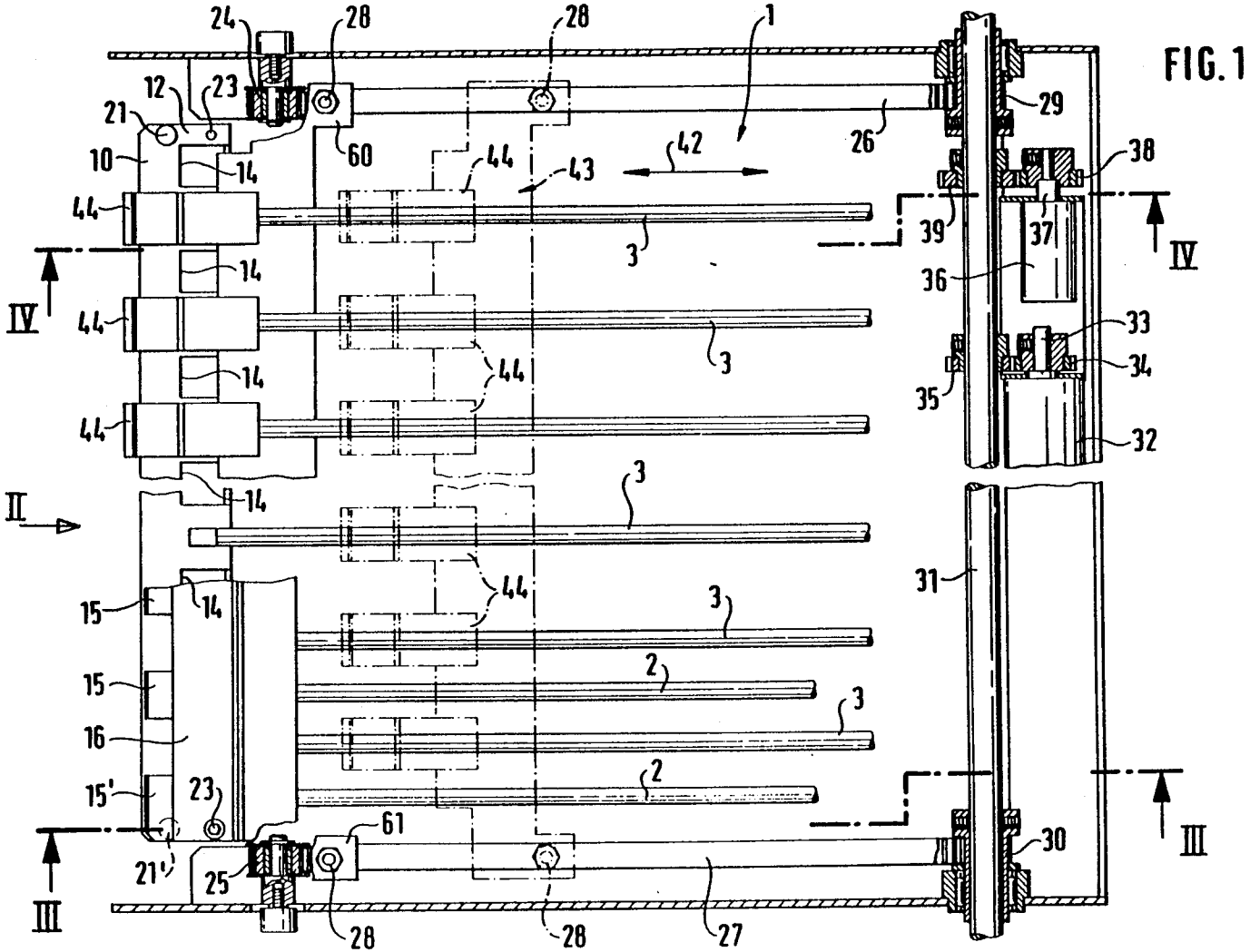
FIG. 1 is a partially cutaway top view of a folding pocket.
Figure 3:
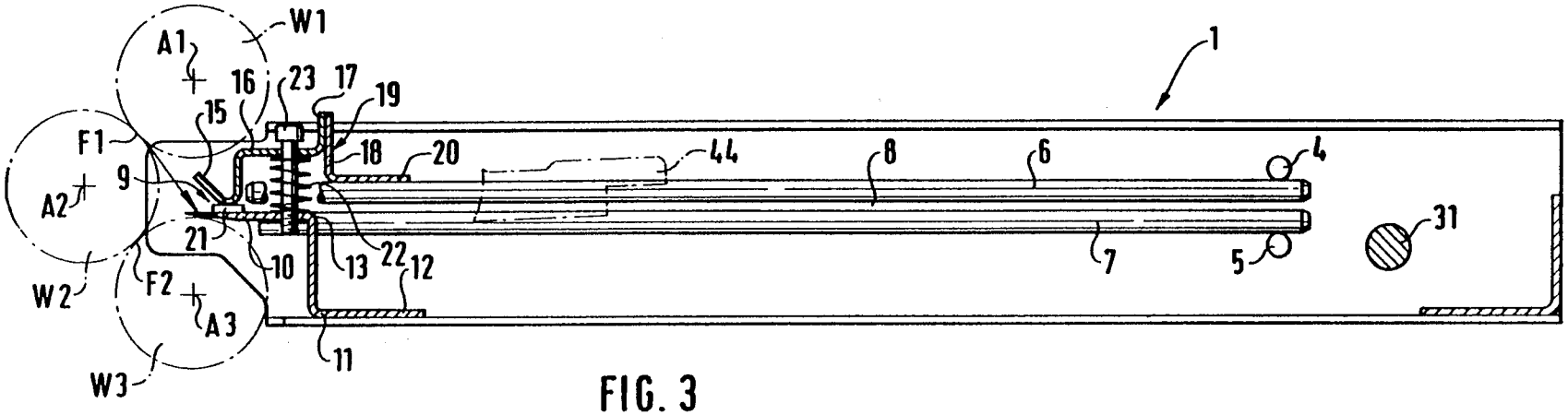
FIG. 3 is a simplified sectional representation taken along line III—III from FIG. 1.

FIG. 1 shows, in a simplified manner, a partially cutaway top view, divided in half of a folding pocket 1, which comprises a plurality of lattice bars 2 and 3, which are arranged staggered and at spaced locations one above the other, and which are connected to one another by cross bars 4 and 5 to form an upper lattice 6 and a lower lattice 7, and form an intake slot 8 between them (FIG. 3). While the lower lattice 7, which consists of the lattice bars 3, and which also forms the bottom of the folding pocket, is arranged stationarily, the upper lattice 6 can be tilted up around the axis of the cross bar.

The intake-side end of the folding pocket 1, which will hereinafter be called the folding pocket mouth 9, has, as the lower lip of the folding pocket mouth 9, a guide bar 10, whose paper guide surface is located in the plane of the intake slot 8. The guide bar 10 is part of an angle rail 11, with which it is made in one piece, and the angle rail 11 is stationarily attached to a frame (not shown) by means of a rear-side fastening rail 12. In the area of the upper bending edge 13, which is rounded off on its rear side, the guide bar 10 is provided with rectangular recesses 14, which enable a stop rail 43 of the folding pocket 1, which stop rail 43 has a U-shaped profile, to move up to this area.

The upper lip of the folding pocket mouth 9 is formed by guiding tongues 15, which are bent at an acute angle and which are made in one piece with an upper guide rail 16 extending at a spaced location from and in parallel to the guide bar 10. For reasons of clarity, the guide bar 10 with the guiding tongues 15 is represented only in the lower half of FIG. 1, as well as in FIGS. 3 and 4. By means of an upright edge 17, it is attached to the vertical leg 18 of an angle plate 19, whose horizontal leg 20 is rigidly connected, e.g., welded, to the front end sections of the upper lattice bars 6 of the folding pocket 1.

To maintain the guiding tongues 15 at a minimum distance from the guide bar 10 at all times, spacing blocks 21 are arranged under the edge guiding tongues 15' on the guide bar 10. In addition, to reduce the contact pressure of the guiding tongues 15' on the spacing blocks 21, support springs 22, which are guided by vertical screws 23, are arranged between the guide bar 10 and the guide rail. These screws are screwed into the guide bar 10 such that they permit the guide rail 16 to perform an upward movement by a few mm.

Three folding rollers W1, W2, and W3 are arranged in front of the folding pocket mouth 9 of the folding pocket 1 such that they form two folding stations, namely, a first folding station F1 and a second folding station F2, and that the axes A1 and A2 of the two folding rollers W1 and W3 are located vertically one above the other.

The stop rail 43 with U-shaped profile, which is attached by screws to the upper strand of two toothed belts 26, 27, so that the stop rail 43 can be displaced in the longitudinal direction of the folding pocket 1, is located in the folding pocket 1. This displacement of the stop rail 43 is accomplished by means of said two toothed belts 26, 27, which are arranged alongside the folding pocket 1, are guided over a deflecting roller 24, 25 on the inlet side, and are driven by a motor from the belt pulleys 29, 30 of a common drive shaft 31. The drive shaft 31 is driven by an electric motor 32, whose shaft 33 is in drive connection with the drive shaft 31 via two gears 34 and 35. In addition, there is provided a helical potentiometer 36, whose adjusting shaft 37 is also in drive connection with the drive shaft 31 via two gears 38 and 39, and which serves to register the actual angular position of the stop rail 43 and to communicate it to a control electronic unit (not shown). This control electronic unit also controls the electric motor 32.

Figure 2:
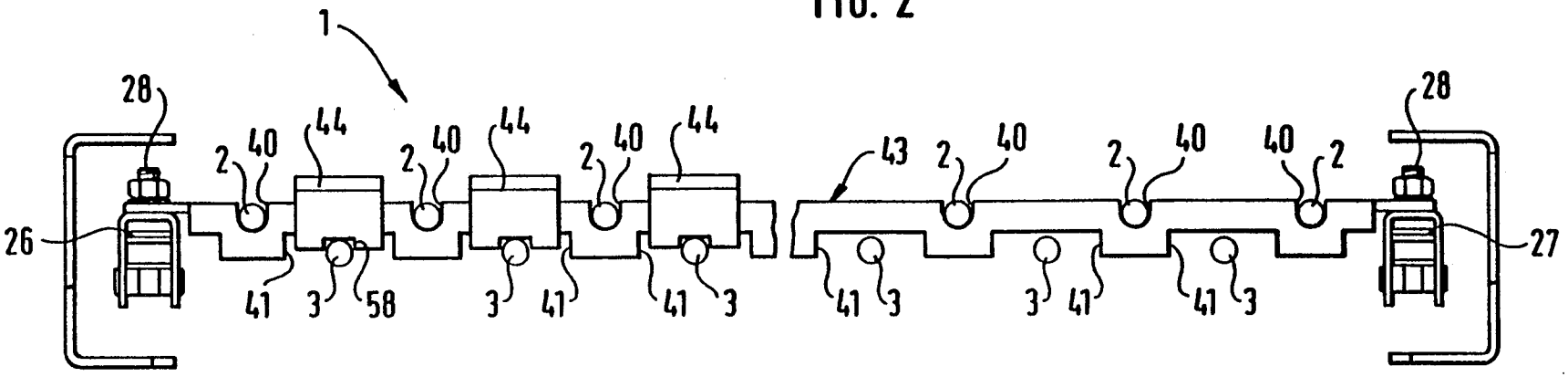
FIG. 2 is a front view in the direction of arrow II, divided in half, from FIG. 1.

As can be best recognized from FIG. 2, the stop rail 43 with U-shaped profile has, on its top side, groove-like depressions 40, in which the upper lattice bars 2 of the folding pocket 1 are guided with slight clearance, and rectangular recesses 41, in whose centers the lower lattice bars 3 extend, are provided on its underside. The stop rail 43 is thus guided between the upper and lower lattice bars 2, 3 of the folding pocket, and is movable in the direction of the double arrow. While the lateral surface of this stop rail 43 facing the folding pocket mouth is used as a stop surface and consequently as an advance limiter for the paper sheet entering the folding pocket 1 in the prior-art buckle folding machines, the stop rail 43 of the buckle folding machine according to the present invention is provided with a plurality of stop fingers 44 of identical design, which are adjustable with the stop rail 43 such that in positions located within the folding pocket 1, they act as a stop and an advance limiting means for the material entering for folding, and they act as a paper deflector in a front end position, which is also the deflecting position. This means that the stop fingers 44 incorporate the paper deflecting means in their deflecting position shown by solid line in FIGS. 1 and 4.

Figure 5:
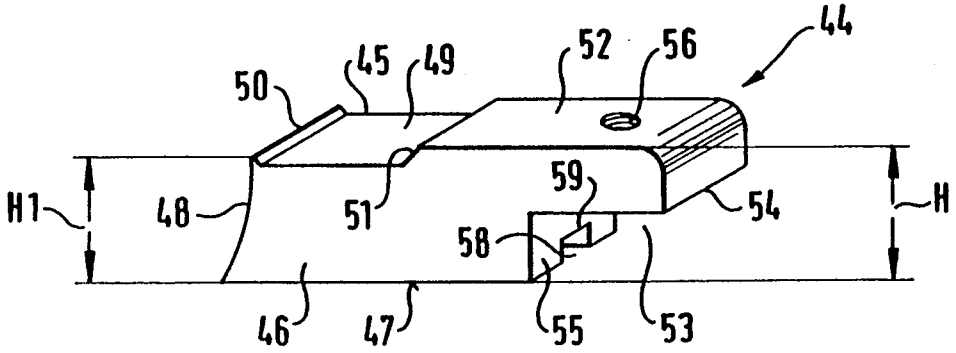
FIG. 5 is a perspective view of a stop finger as an individual part.

As can be best recognized from FIG. 5, such a stop finger 44 consists of an elongated, massive body with two parallel side surfaces 45, 46, a flat bottom surface 47 extending at right angles thereto, and a concave front end face 48. The top side has a first surface section 49, which extends over approximately half of the top side and is located somewhat deeper than the upper limiting edge 50 of the end face 48. This said first surface section 49 is joined, via a bevel 51, by a second surface section 52, which is staggered in the upward direction in relation to both the upper limiting edge 50 and to the first surface section 49. This surface section, which is parallel to the bottom surface 47, has a height H, in relation to the bottom surface 47, which is somewhat greater than the vertical distance between the guide rail 16 held by the support spring 22 and the guide bar 10. It is achieved as a result that the stop fingers 44 are additionally fixed in their deflecting position (FIG. 4) due to the guide rail 16 lying, with its own weight, on the surface sections 52, and pressing the stop fingers 44 with the bottom surfaces 47 as a whole onto the guide bar 10.

The height H1 of the end face 48 is selected to be such that it will be slightly smaller than the distance between the two folding rollers W1 and W3 located one above the other, so that this distance is bridged over nearly completely by the end faces 48 in the deflecting position of (FIG. 4) the stop fingers.

Figure 4:
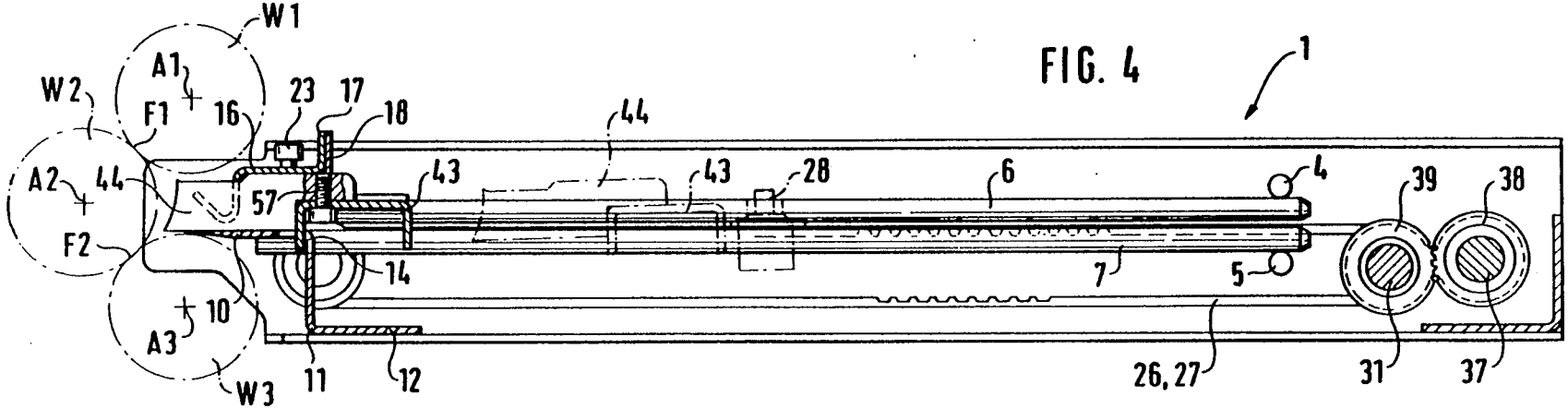
FIG. 4 is a simplified sectional representation taken along line IV—IV from FIG. 1, in which the paper deflector means is in its deflecting position.

At the rear end section, the stop finger 44 has, on its underside, a rectangular opening 53 with a horizontal support surface 54 and a vertical contact surface 55. In the support surface 54, there is a threaded hole 56 for a fastening screw 57, with which the individual stop fingers 44 are fastened to the stop rail 43, as can be seen in FIG. 4, such that the support surfaces 54 are seated on the top side of the stop rail 43, and the contact surfaces 55 are in contact with its front side.

A longitudinal groove 58, whose width approximately corresponds to the diameter of a said lower lattice bar 3, and whose depth is somewhat smaller than half the diameter of the lattice bar 3, is provided in the bottom surface 47. As can be seen in FIG. 2, the stop fingers 44 are arranged such that the lower lattice bars 3 extend in the longitudinal groove 58 of a said stop finger 44, and the stop fingers 44 lie loosely on a said lattice bar 3 with the groove surface area 59. As a result, it is ensured that the front end faces 48 of the stop fingers 44, which act as stops, end below the plane of the intake slot 8 and material entering for folding is unable to pass through under the stop fingers 44, but will be stopped at the end face 48. In folding machines which have a plate with guide ribs extending longitudinally as the folding pocket bottom, the guide ribs are guided in the longitudinal grooves 58, instead of the lattice bars 3.

Since the stop rail 43 is attached to the flexible toothed belts 26, 27 only with its lateral fastening straps 60, 61, the stop fingers 44 attached to the stop rail 43 are also flexible in the vertical direction, i.e., they are pivotable by an angle of about 10° in the vertical direction. This offers the advantage that the slightly concave end faces 48 are able to assume a somewhat steeper position within the folding pocket than in the deflecting position according to FIG. 4, in which the end faces 48 must assume a somewhat more inclined position for correct function, in order for the material to be folded, arriving from the folding station F1, to be reliably guided past the folding pocket 1 and directly into the folding station F2. These different positions of the stop fingers 44 can be seen in FIGS. 3 and 4.

If the stop rail 43 is guided rigidly laterally, fastening of the stop fingers 44 is preferably selected, and the stop fingers 44 will permit a relative pivoting movement, which should be at least 3°, between the stop fingers 44 and the stop rail 43.

The electric motor 32 which brings about the desired adjustment of the stop fingers 44 and the stop rail 43 is controlled, in the usual manner, by an electronic programming unit, or manually. The advantageous possibility of varying the front deflecting position of the stop fingers 44 in the millimeter range, so that the optimal adjustment will be guaranteed for the given type of the material to be folded, is also immediately provided.

It is also advantageous for the stop fingers 44 to be made of a material of high specific gravity, e.g., steel, i.e., to have a large inert weight, which cannot be easily forced by the material striking it to move or vibrate. This ensures high reliability of operation even at high work speeds and in the case of heavy materials to be folded.

While a specific embodiment of the invention has been shown and described in detail to illustrate the application of the principles of the invention, it will be understood that the invention may be embodied otherwise without departing from such principles.

What is claimed is:

1. A buckle folding machine, comprising:

a pair of folding rollers;

a folding pocket having a width and including a stop rail extending over said width, said folding pocket having a mouth, said stop rail being attached to paper deflecting means for deflecting paper from the pair of folding rollers; adjusting means for adjusting the position of the stop rail and paper deflecting means between a folding pocket mouth open position and a deflecting position in which the folding pocket mouth is closed, said adjusting means capable of being manually or programmably controlled;

said deflecting means including a plurality of stop fingers connected to said stop rail, said plurality of stop fingers facing said folding pocket mouth, each of said plurality of fingers having a front end face located in a common plane, each said front end face cooperating as a paper stop within said folding pocket and being movable with said stop rail by said adjusting means into a front deflecting position wherein said end faces of said fingers act together as a paper deflector and guide for deflecting and guiding material arriving at said folding pocket mouth past the folding pocket to a subsequent folding machine station;

pivot connection means connecting one of said stop fingers to said stop rail and said stop rail to said folding pocket for pivoting of said stop fingers with respect to said folding pocket by at least 3° in a vertical direction;

a stationary guide bar forming a lower lip of said folding pocket mouth, said stop fingers lying on said guide bar in said front deflecting position; and a guide rail positioned above said guide bar, spaced a vertical distance approximately corresponding to a height of said stop fingers, said guide rail extending in parallel to said guide bar and lying on said stop fingers in said front deflecting position for stabilizing said stop fingers.

2. A buckle folding machine according to claim 1, wherein:

the position of said stop fingers in said front deflecting position is adjustable by said adjusting means for positions corresponding to different thicknesses of material to be folded.

3. A buckle folding machine according to claim 1, further comprising:

an additional roller, said additional roller and one of said pair of folding rollers being arranged on each side of said folding pocket mouth, said front end face of each finger having a height which is slightly smaller than a distance between said additional roller and said one of said pair of folding rollers.

4. A buckle folding machine according to claim 1, wherein:

said front end face of each stop finger is formed as a concave arch.

5. A buckle folding machine according to claim 1, wherein:

said stop fingers have an underside with a longitudinal groove forming a grooved surface area lying on a lattice bar of said folding pocket.

6. A buckle folding machine according to claim 1, wherein:

said pivot connection means comprises a pivot connection between each stop finger and said stop rail allowing relative pivoting movement between said stop fingers and said stop rail of at least three degrees.

7. A buckle folding machine according to claim 1, further comprising: a flexible belt for moving said stop rail, said connection of said stop rail to said flexible belt defining said pivot connection means for allowing pivoting movement of said stop fingers.

8. A buckle folding machine, comprising:

a pair of folding rollers;

a folding pocket having a width and including a stop rail extending over said width, said folding pocket having a mouth, said stop rail being attached to paper deflecting means for deflecting paper from the pair of folding rollers; adjusting means for adjusting the position of the stop rail and paper deflecting means between a folding pocket mouth open position and a deflecting position in which the folding pocket mouth is closed;

said deflecting means including a plurality of stop fingers connected to said stop rail, said plurality of fingers facing said folding pocket mouth, each of said plurality of fingers having a front end face located in a common plane, each said front end face having a concave surface cooperating as a paper stop within said folding pocket and being movable with said stop rail by said adjusting means into a front deflecting position wherein said end. faces of said fingers act together as a paper deflector and guide for deflecting and guiding material arriving at said folding pocket mouth past the folding pocket to a subsequent folding machine station;

pivot connection means connecting one of said stop fingers to said stop rail and said stop rail to said folding pocket for pivoting of said stop fingers with respect to said folding pocket by at least 3° in a vertical direction;

a stationary guide bar forming a lower lip of said folding pocket mouth, said stop fingers lying on said guide bar in said front deflecting position; and a guide rail positioned above said guide bar, spaced a vertical distance approximately corresponding to a height of said stop fingers, said guide rail extending in parallel to said guide bar and lying on said stop fingers in said front deflecting position for stabilizing said. stop fingers; and a flexible tooth belt connected to said stop rail, a connection between said stop rail and said flexible tooth belt defining said pivot connection means, allowing said stop fingers to pivot upon engaging said guide bar.

9. A buckle folding machine according to claim 8, wherein:

the position of said stop fingers in said front deflecting position is adjustable by said adjusting means for positions corresponding to different thicknesses of material to be folded.

10. A buckle folding machine according to claim 8, further comprising:

an additional roller, said additional roller and one of said pair of folding rollers being arranged on each side of said folding pocket mouth, said front end face of each finger having a height which is slightly smaller than a distance between said additional roller and said one of said pair of folding rollers.

11. A buckle folding machine according to claim 8, wherein:

said stop fingers have an underside with a longitudinal groove forming a grooved surface area lying on a lattice bar of said folding pocket.

* * * * *